US011592220B2

(12) United States Patent
Da Silva Castro et al.

(10) Patent No.: US 11,592,220 B2
(45) Date of Patent: Feb. 28, 2023

(54) REFRIGERANT COMPRESSOR

(71) Applicant: Secop GmbH, Flensburg (DE)

(72) Inventors: Mattias Da Silva Castro, Graz (AT); Shuai Wang, Tianjin (CN); Marcos Hattori, Fürstenfeld (AT)

(73) Assignee: SECOP GMBH, Flensburg (DE)

( * ) Notice: Subject to any disclaimer, the term of this patent is extended or adjusted under 35 U.S.C. 154(b) by 521 days.

(21) Appl. No.: 16/855,599

(22) Filed: Apr. 22, 2020

(65) Prior Publication Data

US 2020/0340720 A1 Oct. 29, 2020

(30) Foreign Application Priority Data

Apr. 23, 2019 (EP) ..... 19170524

(51) Int. Cl.
*F04B 39/00* (2006.01)
*F04B 39/02* (2006.01)
*F25B 31/02* (2006.01)

(52) U.S. Cl.
CPC ..... *F25B 31/023* (2013.01); *F04B 39/0044* (2013.01); *F04B 39/023* (2013.01); *F25B 2400/07* (2013.01); *F25B 2500/13* (2013.01)

(58) Field of Classification Search
CPC ..... F25B 31/023; F25B 2400/07; F25B 2500/13; F04B 39/0044; F04B 39/023; F04B 39/121; F04B 39/127; F04C 23/008; F04C 29/068
USPC ..... 417/363
See application file for complete search history.

(56) References Cited

U.S. PATENT DOCUMENTS

| | | | |
|---|---|---|---|
| 3,385,542 | A | 5/1968 | Enemark et al. |
| 4,312,627 | A | 1/1982 | Jacobs et al. |
| 2016/0195080 | A1 | 7/2016 | Miguel et al. |
| 2018/0087494 | A1 | 3/2018 | Brune et al. |

FOREIGN PATENT DOCUMENTS

| | | |
|---|---|---|
| WO | 2016/166320 | 10/2016 |

OTHER PUBLICATIONS

Europe Search Report/Office Action conducted in counerpart Europe Appln. No. EP 19 17 0524 (dated Jul. 25, 2019).

*Primary Examiner* — Kenneth J Hansen
*Assistant Examiner* — Benjamin Doyle
(74) *Attorney, Agent, or Firm* — Greenblum & Bernstein, P.L.C.

(57) ABSTRACT

Refrigerant compressor with a hermetically sealed housing and a drive unit in the interior of the housing. At least one damping element is in the housing is connected to the drive unit. The damping element has three contact areas separated from each other by an edge, in which in a first deflected state of the drive unit a first contact area contacts a first inner surface area of the housing, wherein in a second deflected state a second contact area contacts a second inner surface area of the housing, but the first contact area does not contact the first inner surface area, wherein in a third deflected state of the drive unit a third contact area contacts a third inner surface area, but the first and second contact areas do not contact the first and second inner surface areas, respectively.

15 Claims, 8 Drawing Sheets

REFRIGERANT COMPRESSOR

FIELD OF THE INVENTION

The present invention relates to a refrigerant compressor comprising a hermetically sealed housing and a drive unit disposed in the interior of the housing, wherein at least one damping element for damping and limiting a deflection of the drive unit is provided in the interior of the housing, wherein the damping element is connected to the drive unit, wherein the damping element has at least one first contact area, wherein in a basic state of the drive unit the at least one first contact area has a distance to a corresponding inner surface area of the housing, wherein in a first deflected state of the drive unit a first contact area is in contact with a corresponding first inner surface area of the housing, wherein the surface of the first inner surface area is parallel to the outer surface of this first area of the housing.

There can be one or more damping elements which are connected to the drive unit. That the surface of the first inner surface area is parallel to the outer surface of this first area of the housing means that the housing has a wall which wall is deformed so that the wall thickness basically stays the same and the deformed inside and outside surface in this area is still basically parallel to each other. In other words the wall of the housing has an inner surface and an outer surface. In a first area of the housing the inner surface is called first inner surface area and the outer surface is called outer surface of this first area. The housing is normally produced from metal sheet by deep drawing or hydroforming.

The drive unit normally comprises a piston/cylinder unit for cyclical compression of a refrigerant, and an electric motor for drive of the piston/cylinder unit. In the basic state of the drive unit the at least one contact area has a distance to the inner wall of the housing.

PRIOR ART

In the case of refrigerant compressors that comprise a hermetically sealed housing and a drive unit disposed in the interior of the housing, relatively great forces occur, particularly during start and stop procedures, which forces lead to correspondingly relatively great deflections of the drive unit in the housing. In this regard, the drive unit, usually at its bottom side, is connected to the bottom of the housing for vibration damping, usually by way of spring elements, which permit deflection of the drive unit. Particularly in the case of refrigerant compressors having a variable speed of rotation, or refrigerant compressors having constant but lower speed, for example refrigerant compressors in mobile applications with fixed speed at about 2000 rpm, the spring elements must be designed in relatively soft manner because of the low speeds of rotation that occur during operation, and this in turn results in greater deflections of the drive unit. A damping apparatus is provided in order to prevent contact of the drive unit with the housing in this connection, especially with the top part of the housing. The top part of the housing is the part which faces upward when the compressor is in use.

Such damping apparatus according to the state of the art for example have a cap as an extra component, which is not part of the shape of the housing wall itself, disposed in the housing interior and rigidly connected with the housing—typically welded to the housing—which cap defines a movement volume, see e.g. WO 2016/166320 A1. A metal bolt is disposed in a clear cross-section of the cap, which bolt is rigidly connected with the drive unit (and not part of the drive unit) and the damping element which encloses the metal bolt is made of rubber. This damps and limits the deflection of the drive unit. However, such caps must be fixed additionally onto the housing. In FIG. 9 of WO 2016/166320 A1 there is no cap, instead the housing wall is suitably shaped, in order to limit the movement volume at least in certain sections. The housing wall as shown, however, does only give a defined limitation in vertical direction but no defined limitation in horizontal direction. Some embodiments of WO 2016/166320 A1 suggest a rotationally symmetric cap.

This is not enough for compressors which are used for mobile applications, like for cooling applications in vehicles, since there the drive unit of the compressor during its operation also experiences accelerations and retardations within its housing when the vehicle accelerates and breaks. Additionally, the inclination of the—operating—compressor changes when the vehicle ascends or descends a hill.

OBJECT OF THE INVENTION

It is therefore the object of the invention to provide a refrigerant compressor that is suitable for use in mobile applications. In particular, the refrigerant compressor according to the invention is supposed to prevent or at least minimize disruptive noise development in connection with acceleration and retardation and inclination of the vehicle the refrigerant compressor is mounted to.

PRESENTATION OF THE INVENTION

It is the core of the invention to further improve the damping properties and, in this regard, to particularly prevent metallic noises, in that a damping element composed of a polymer material or of vulcanized rubber is provided.

In this regard, a polymer material is understood to mean a material or plastic in accordance with DIN 7724, which comprises duroplastics, elastomers, thermoplastics and thermoplastic elastomers. From what has been said, it is evident that rubber, which can be produced both from a natural material and from a synthetic material, is a possible material for the damping element.

The invention relates to a refrigerant compressor according to claim 1. Accordingly, a refrigerant compressor is claimed comprising a hermetically sealed housing and a drive unit disposed in the interior of the housing, wherein at least one damping element for damping and limiting a deflection of the drive unit is provided in the interior of the housing, wherein the damping element is connected to the drive unit, wherein the damping element has at least one first contact area, wherein in a basic state of the drive unit the at least one first contact area has a distance to a corresponding inner surface area of the housing, wherein in a first deflected state of the drive unit a first contact area is in contact with a corresponding first inner surface area of the housing, wherein the surface of the first inner surface area is parallel to the outer surface of this first area of the housing.

According to the invention it is provided that in a second deflected state of the drive unit a second contact area is in contact with a corresponding second inner surface area of the housing, but the first contact area is not in contact with the first inner surface area of the housing, whereas the surface of the second inner surface area is parallel to the outer surface of this second area of the housing, whereas the first direction of movement from the basic state to the first deflected state is perpendicular to the second direction of movement from the basic state to the second deflected state, and that in a third deflected state of the drive unit a third contact area is in contact with a corresponding third inner surface area of the housing, but the first contact area is not in contact with the first inner surface area and the second contact area is not in contact with the second inner surface area, whereas the surface of the third inner surface area is parallel to the outer surface of this third area of the housing, whereas the third direction of movement from the basic state to the third deflected state is perpendicular to the second direction of movement from the basic state to the second deflected state and to the first direction of movement from the basic state to the first deflected state, and in that first contact area, second contact area and third contact area are separated from each other by at least one edge. In other words, the movement of the drive unit is limited in three directions. The first inner surface area of the housing e.g. limits the deflection of the unit in vertical direction, which is known from WO 2016/166320 A1. However, in FIG. 9 of WO 2016/166320 A1 the housing wall 8 does not give a defined limitation to the outer wall 31 of the damping element in lateral direction.

One benefit of having three different contact regions which can contact in different situations is that the drive unit has more freedom to move without touching during start/stop, that is more freedom for rotation movement, especially rotation in a horizontal plane.

According to the present invention the housing is formed such that it delimits the movement of the damping element (and thus of the drive unit) also in both lateral directions, i.e. in two distinct directions perpendicular to the vertical direction. In that first contact area, second contact area and third contact area are separated from each other by at least one edge, one contact area is separated from every other contact area. This allows defined characteristics of the damping element in one vertical and two lateral directions, whereas according to the state of the art, WO 2016/166320 A1, FIG. 1-8, a rotationally symmetric cap is suggested which treats all lateral directions the same. In FIG. 9 of WO 2016/166320 A1 the damping element again is rotationally symmetric and has the same properties in all lateral directions. In other words, this damping element has two contact areas, one on top and one in the form of the outer wall 31, the outer wall having constant curvature in circumferential direction. There is just one circular edge between the contact area on top and the outer wall 31.

An edge in connection with the present invention here is understood as an area of greater curvature than the neighboring contact areas. As a consequence of the edges of the damping element the inner surface areas of the housing normally are also separated by edges. Preferably the contact areas of the damping element are arranged adjacent to each other and separated from each other by one edge.

First, second or third deflected state of the drive unit each is an extreme state which describes 100% deflection in a certain direction. Such extreme state will hardly be reached during normal operation. During normal operation the drive unit will be in a superposition state of deflection with less than 100% deflection in all three directions.

One status of the damping element according to the invention can be that the first contact area is in contact with the corresponding first inner surface area of the housing and at the same time the second contact area is in contact with the corresponding second inner surface area of the housing. Another status of the damping element according to the invention can be that the first contact area is in contact with the corresponding first inner surface area of the housing and at the same time the third contact area is in contact with the corresponding third inner surface area of the housing. Another status of the damping element according to the invention can be that the second contact area is in contact with the corresponding second inner surface area of the housing and at the same time the third contact area is in contact with the corresponding third inner surface area of the housing.

Another status of the damping element according to the invention can be that the first contact area is in contact with the corresponding first inner surface area of the housing and at the same time the second contact area is in contact with the corresponding second inner surface area of the housing and at the same time the third contact area is in contact with the corresponding third inner surface area of the housing.

The housing, in particular the top part, generally has a continuous convex form which means that, in any cross section, the curve of the housing wall is continuously differentiable, there is no step or bend or edge. For forming the necessary inner surface areas the housing needs to deviate from this continuous convex form. So there can be convexities reaching above the original continuous convex form and there can be indentations, notches, concavities going below the original continuous convex form. From the viewpoint of the damping elements the three inner surface areas, which can be contacted, will constitute a bulge, irrespective if they are realised as convexities and/or as concavities of the continuous convex form of the housing. Bulges containing mainly convexities are bulges 18*a,b* in FIG. 1-4, a bulge containing mainly concavities/indentations is bulge 17*a*, see its second inner surface area 12 in FIG. 6. Bulge 17*b* contains both, e.g. a concavity followed by a convexity, see e.g. FIGS. 6 and 11.

In a second area of the housing the inner surface is called second inner surface area and the outer surface is called outer surface of this second area. In a third area of the housing the inner surface is called third inner surface area and the outer surface is called outer surface of this third area.

One embodiment of the invention consists in that the surface form of the first contact area of the damping element corresponds to the surface form of the first inner surface area of the housing, and/or the surface form of a second contact area of the damping element corresponds to the surface form of a second inner surface area of the housing, and/or the surface form of a third contact area of the damping element corresponds to the surface form of a third inner surface area of the housing. Correspondence here means that the surface form of the contact area of the damping element and the surface form of the related inner surface area of the housing are the same. So there is at least one status of form fit between this contact area of the damping element and the related inner surface area of the housing. For example, the surface form of the contact area of the damping element is a plane and the surface form of the related inner surface area of the housing also is a plane. Or in another example the surface form of the contact area of the damping element has a certain curvature and the surface form of the related inner surface area of the housing has the same curvature. Normally the surface of the contact area of the damping element and the surface of the related inner surface area of the housing are parallel in the basic state of the drive unit.

In a preferred embodiment of the refrigerant compressor according to the invention, at least two contact areas of the damping element are planar and oriented perpendicular to each other. A planar surface gives a defined stop in the direction perpendicular to the plane of the contact area. Accordingly, in this case the corresponding inner surface areas of the housing preferably will also be planar and oriented perpendicular to each other.

A preferred embodiment of the invention consists in that a third contact area of the damping element is planar and oriented perpendicular to the other two contact areas. This yields a defined stop in three directions of movement, perpendicular to the planes of the contact areas. Accordingly, in this case the three corresponding inner surface areas of the housing will preferably also be planar and oriented perpendicular to each other.

According to a preferred embodiment of the invention the damping element covers at least one protruding part of the drive unit in an amount of more than 180°, preferably more than 250°. Since the protruding part of the drive unit is a part of the drive unit itself, the protruding part and the drive unit are one-part, they are machined from one piece or molded as one piece. This solution is different from the bolts of the state of the art which have to be connected to the drive unit. The drive unit according to this embodiment of the invention can contain a so called block which itself contains e.g. the cylinder housing, and/or which contains the crankshaft bearing, and this block can have at least one protruding part.

Since the damping element in this case encompasses (in the sense of embraces) one protruding part of the drive unit in an amount of more than 180°, preferably more than 250°, this leads to a good connection with this part of the drive unit. The amount of degree can be measured if one places an axis through this protruding part and measures circumferentially from the beginning to the end of the damping element relative to this axis.

According to a preferred embodiment of the invention the protruding part of the drive unit has at least two, preferably three, planar surface areas which are covered by the damping element, which are oriented perpendicular to each other and which are oriented parallel to two, preferably three, planar contact areas of the damping element. In other words, the damping element then has constant thickness in each of the contact areas which supports a uniform damping effect for one contact area in the direction perpendicular to the respective contact area. The at least two, preferably three, planar surface areas of the protruding part are preferably adjacent to each other.

Given a certain rigidity of the damping element, the damping element can be snap-fit onto a, favorably protruding, part of the drive unit.

In an alternative embodiment of the invention the damping element can be injection molded to a part of the drive unit. This yields a very strong bond between damping element and the part of the drive unit.

In one embodiment of the invention, for one damping element, in a fourth deflected state of the drive unit a fourth contact area is in contact with a corresponding fourth inner surface area of the housing, whereas the surface of the fourth inner surface area is parallel to the outer surface of this fourth area of the housing, whereas the fourth direction of movement from the basic state to the fourth deflected state is antiparallel to the direction of movement from the basic state to the second deflected state.

This means that one damping element provides for an additional limitation in a fourth direction which fourth direction is antiparallel to one of the necessary first, second and third directions. So the damping element has two contact areas opposite to each other, especially parallel to each other, one acting e.g. in positive direction of an axis and the other acting in negative direction of the same axis. Assuming that first, second and third direction of movement from the basic state to first, second and third deflected state is along positive x-axis, positive y-axis and positive z-axis of an orthogonal coordinate system, then this damping element additionally provides for a defined limitation in the direction of e.g. the negative y-axis. See FIG. 1-4 for this embodiment of the invention.

Starting from this embodiment (with four contact areas per damping element) one further embodiment consists in that there are two such damping elements whereas the directions of movement from the basic state to the third deflected state are antiparallel. Assuming that first, second and third direction of movement from the basic state to first, second and third deflected state is along positive x-axis, positive y-axis and positive z-axis of an orthogonal coordinate system, and fourth direction of movement from the basic state to fourth deflected state is along the negative y-axis, then the two damping elements together additionally allow for a defined limitation in the direction of e.g. the negative x-axis. See FIG. 1-4 for this embodiment of the invention.

In another embodiment of the invention, there is a first and a second damping element, whereas the first direction of movement from the basic state to the first deflected state and the third direction of movement from the basic state to the third deflected state is the same for both damping elements, and the directions of movement from the basic state to the second deflected state are antiparallel. Assuming that first, second and third direction of movement from the basic state to first, second and third deflected state is along positive x-axis, positive y-axis and positive z-axis of an orthogonal coordinate system, then these two damping elements together provide for a defined limitation in the direction of e.g. positive x-axis, positive y-axis, positive z-axis and negative y-axis. See FIG. 5-9 for this embodiment.

Starting from this embodiment, one further embodiment consists in that there are a third and a fourth damping element, whereas the first direction of movement from the basic state to the first deflected state is the same for all four damping elements, whereas the direction of movement from the basic state to the second deflected state is antiparallel to each other and whereas the direction of movement from the basic state to the third deflected state is antiparallel to the first and second damping element. These four damping elements together provide for a defined limitation in the direction of e.g. positive x-axis, positive y-axis, positive z-axis, negative y-axis and negative x-axis. See FIG. 5-9 for this embodiment.

In order to provide different movement characteristics in different directions, one embodiment of the invention consists in that in a basic state of the drive unit the first contact area has a first distance to the corresponding first inner surface area of the housing, the second contact area has a second distance to the corresponding second inner surface area of the housing and the third contact area has a third distance to the corresponding third inner surface area of the housing, and in that one of these distances is different from another of these distances. So the gaps between damping element and housing can be adapted to the clearing which is needed along the three different orthogonal axes. If the drive unit shall be allowed a greater movement in a first direction then in the basic state the distance between the first contact area of the damping element and the first inner surface area of the housing is greater than for other directions.

Another embodiment of the invention to provide different movement characteristics in different directions consists in that there is a first thickness of the damping element measured at the first contact area, a second thickness of the damping element measured at the second contact area and a third thickness of the damping element measured at the third contact area, and in that one of these thicknesses is different from another of these thicknesses. The thickness of a damping element can also be used to adjust the distance (gap) between a certain contact area of the damping element and the corresponding inner surface area of the housing. If, for certain applications of the same compressor, a higher deflection of the drive unit in a certain direction shall be allowed then the gap for movement in this direction can be increased by using a damping element with less thickness in that certain direction. So based on the same drive unit, especially with the same protruding parts, a series of compressors can be realized by using damping elements with different thicknesses for at least one contact area. A change from one such compressor type to another compressor type then is very easy when the damping elements are only snap-fit onto the (protruding parts of) the drive unit.

In order to provide movement of the drive unit to some extent without limitation, one embodiment of the invention consists in that for a certain damping element the dimensions of first, second and third inner surface area of the housing are dimensioned so that until a certain partly deflected state of the drive unit the drive unit can move without contacting first, second and third inner surface area. See FIG. 10 for this embodiment. The edges of the three inner surface areas of the housing (which inner surface areas basically can be contacted by the damping element) with the adjacent inner surface of the housing are tangents on the surface of a sphere defining the partly deflected state in which the damping element does not contact the housing.

It is also possible to have damping elements according to the invention mounted on the drive unit in the bottom part of the housing, i.e. the bottom part of the drive unit then has at least three respective inner surface areas which are parallel to the outer surface of this area of the housing. Such damping elements are not so effective like damping elements in the top part of the housing because they are too close to the usually provided springs for connecting the drive unit with the bottom part of the housing.

BRIEF DESCRIPTION OF THE FIGURES

The invention will now be explained in greater detail using exemplary embodiments. The drawings are meant as examples and are supposed to present the idea of the invention, but by no means to restrict it or to reproduce it in final manner.

In this regard, the figures show.

WAYS FOR IMPLEMENTATION OF THE INVENTION

Figure 1:
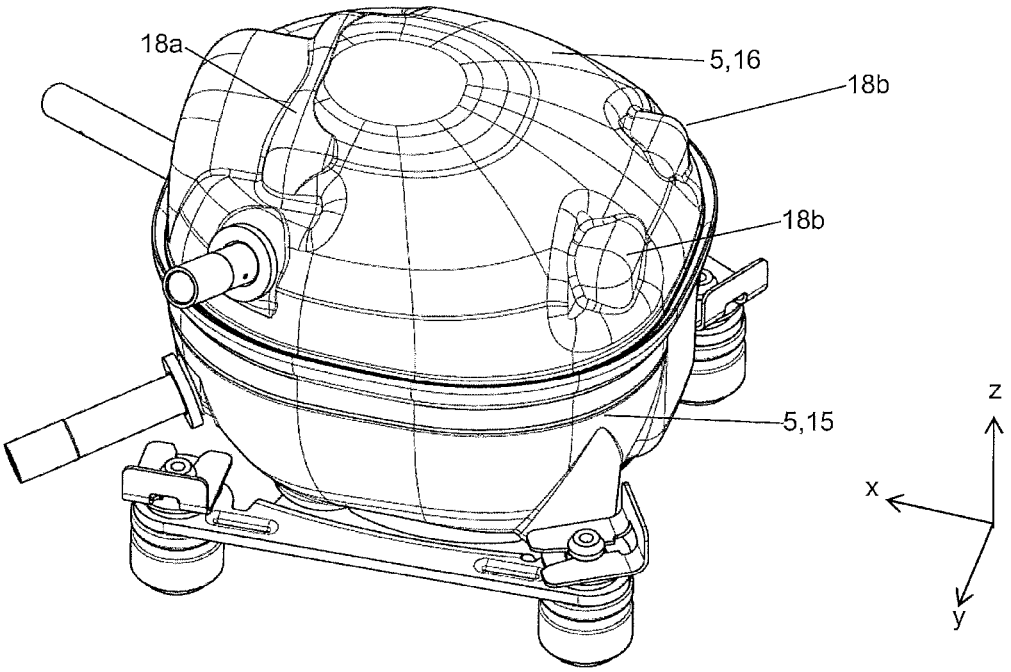
FIG. 1 a first refrigerant compressor according to the invention, seen from a first direction, with two bracket-formed damping elements, FIG. 2 the refrigerant compressor of FIG. 1, seen from a second direction, FIG. 3 the refrigerant compressor of FIG. 1, top part of housing removed, with two bracket-formed damping elements, FIG. 4 the refrigerant compressor of FIG. 3, seen from the other side, FIG. 5 a second refrigerant compressor according to the invention, housing removed, with four cap-formed damping elements, FIG. 6 a view of a longitudinal sectional through the upper portion of the refrigerant compressor of FIG. 5, with housing, FIG. 7 a view of a lateral section through the upper portion of the refrigerant compressor of FIG. 5, with housing, FIG. 8 a perspective view of FIG. 7, FIG. 9 a perspective view of another lateral section through the upper portion of the refrigerant compressor of FIG. 5, the section in front of two cap-formed damping elements, FIG. 10 a schematic sectional view of one damping element and the surrounding housing, FIG. 11 four views of a lateral section through the upper portion of the refrigerant compressor of FIG. 5, for different deflected states, FIG. 12 the view of FIG. 7, whereas an angle between the damping element and the housing is marked, FIG. 13-17 a view of a longitudinal section through the upper portion of the refrigerant compressor of FIG. 5, for different deflected states.
Figure 2:
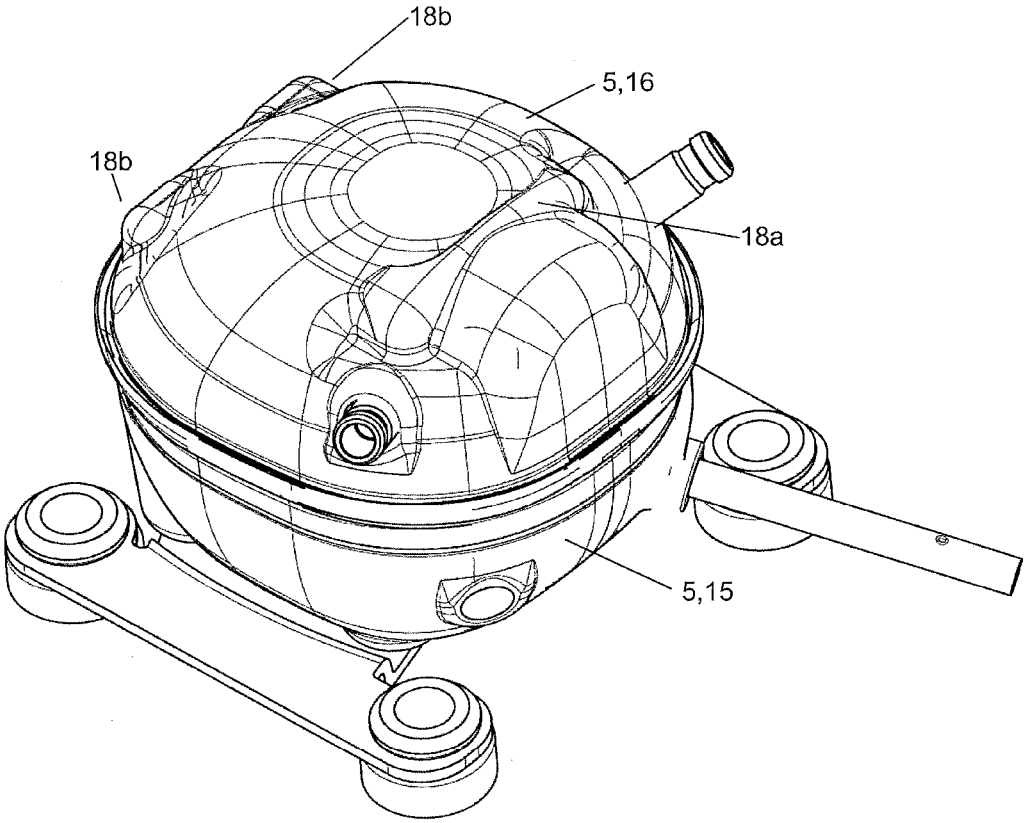

A first embodiment of a refrigerant compressor according to the invention is shown in FIG. 1-4. The refrigerant compressor has a hermetically sealed housing 5, as well as a drive unit 6 disposed in the interior of the housing 5, having a piston/cylinder unit 9 for cyclical compression of a refrigerant, and an electric motor 10 for drive of the piston/cylinder unit 9. The housing 5, also called shell, basically has two parts: a bottom part 15 which faces downward when the compressor is in use, and a top part 16 which faces upward when the compressor is in use. The top part 16 is a cover which is welded to the bottom part 15. The bottom part 15 mainly encloses the electric motor 10 and acts as an oil sump, the top part mainly encloses the piston-cylinder unit 9.

The drive unit 6 is connected to the bottom part 15 of the housing 5 by means of spring elements, not shown, for vibration damping, so that deflections of the drive unit 6 can come about, particularly during start and stop procedures.

Two bracket-formed damping elements 8*a,b* are provided on the drive unit 6, namely on the upper side of block 19 which, beside other functions, acts as the cylinder housing. Damping elements 8*a,b* prevent the drive unit 6 from making contact with the top part 16 of the housing 5. Every movement or deflection of the drive unit 6 brings about a corresponding deflection of the damping elements 8*a,b*. The damping element 8*a,b* can move in a certain extent without touching the top part 16 housing 5. In normal operation, this makes a certain deflection of the drive unit 6 possible. At very big deflections, such as they occur, in particular, during start and stop procedures of the compressor, the damping element 8*a,b* touches the housing 5, thereby causing the damping element 8*a,b* to be elastically deformed and pressed against the housing 5. This damps and limits the deflection of the drive unit 6, and at the same time does not result in undesirable noise development.

Figure 3:
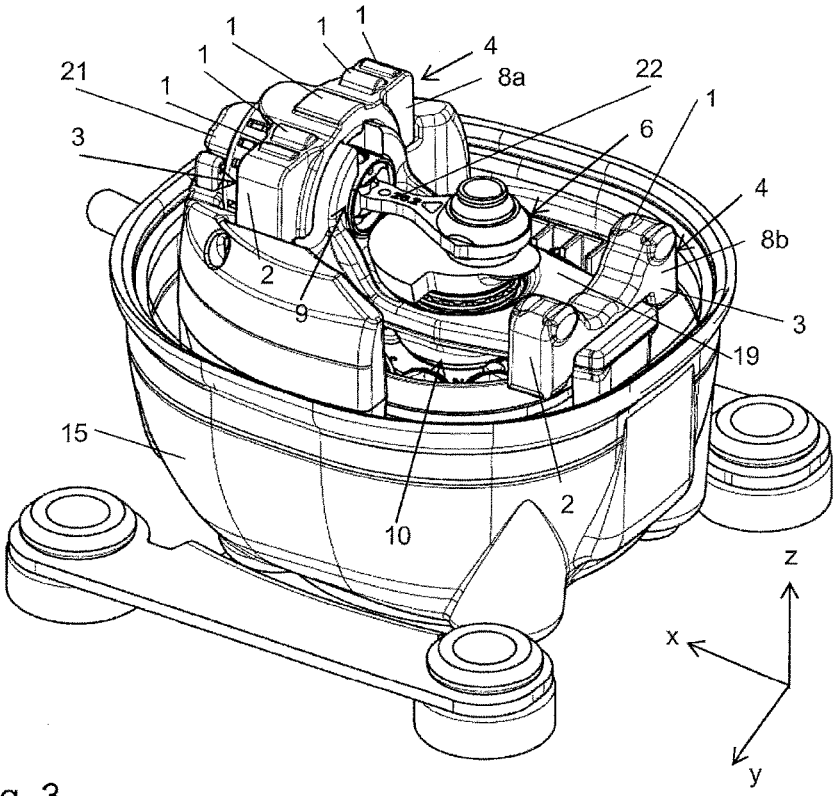
Figure 4:
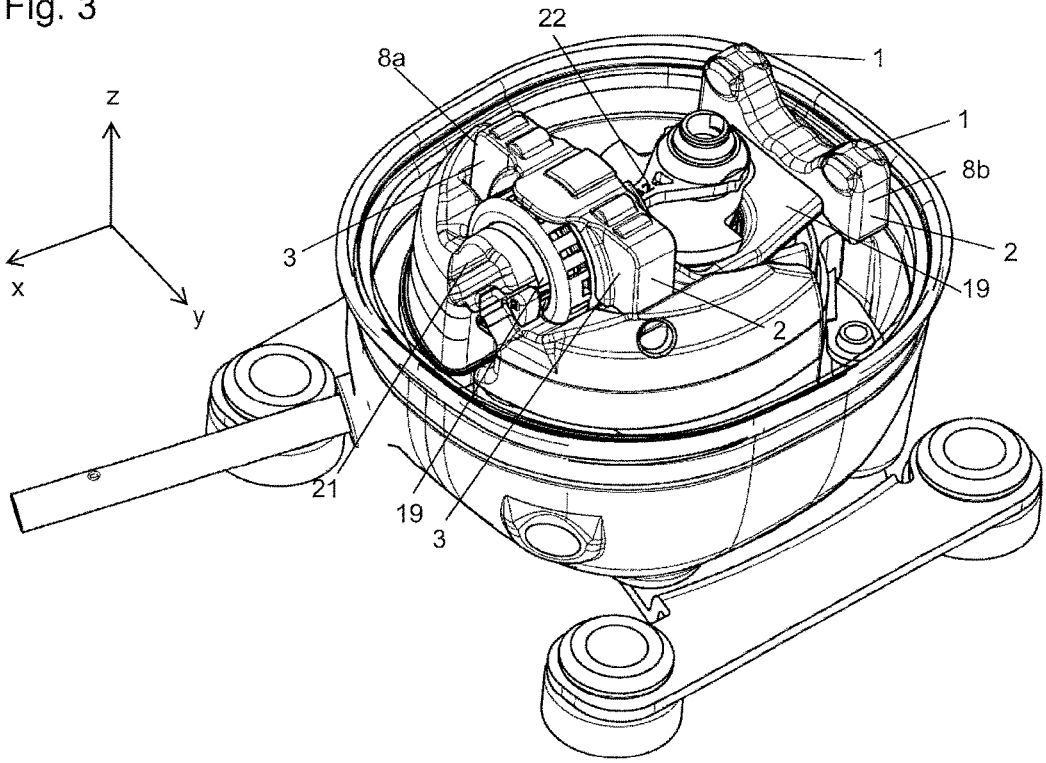

For easier reference the following directions and orthogonal axes are defined:

- a first direction of movement is along the positive z-axis, the z-axis running vertical in FIG. 1-8, parallel to the crankshaft of the drive unit 6, the positive z-axis pointing to the top,
- a second direction of movement is along the positive y-axis, the y-axis running horizontal in FIG. 1-8, perpendicular to the cylinder axis,
- a third direction of movement is along the positive x-axis, the x-axis running horizontal in FIG. 1-8, parallel to the cylinder axis or piston rod 22, the positive x-axis pointing to the left in FIGS. 3 and 4,
- a fourth direction of movement is along the negative y-axis,
- a fifth direction of movement is along the negative x-axis,
- a sixth direction of movement is along the negative z-axis.

Damping element 8*a* is mounted surrounding partially block 19 at the cylinder housing. So damping element 8*a* is situated nearer to the side of the compressor where the cylinder cover 21 and/or the valve plate is situated. Damping element 8*b* is situated nearer to the opposite side of the compressor. Both damping elements 8*a,b* have the form of a bracket and are symmetric to a plane defined by the cylinder axis or piston axis (=x-axis) and z-axis. Both lateral ends (parallel to the y-axis) of the damping elements 8*a,b* each form three contact areas 1,2,3 or 1,3,4.

Referring to FIG. 3 and damping element 8*a*, this damping element 8*a* features one first contact area 1 on the top which itself features several bumps. This first contact area 1 is intended to limit movement of the drive unit 6 along the positive z-axis by contacting the inside of bulge 18*a* on its top. Damping element 8*a* on its near end in FIG. 3 features one second contact area 2, here in the form of an even surface, facing towards the positive y-axis. This second contact area 2 is intended to limit movement of the drive unit 6 along the positive y-axis by contacting the inside of bulge 18*a* on its respective side wall. Damping element 8*a* on its near end features one third contact area 3, here in the form of an even surface, facing towards the positive x-axis. This third contact area 3 is intended to limit movement of the drive unit 6 along the positive x-axis by contacting the inside of bulge 18*a* on its respective side wall.

Damping element 8*a* on its far end in FIG. 3 features one fourth contact area 4, here in the form of an even surface, facing towards the negative y-axis. This fourth contact area 4 is intended to limit movement of the drive unit 6 along the negative y-axis by contacting the inside of bulge 18*a* on its respective side wall. This fourth contact area 4 is symmetric to the second contact area 2, with relation to a vertical symmetry plane through the axis of the cylinder. Damping element 8*a* on its far end features one third contact area 3, here in the form of an even surface, facing towards the positive x-axis. This third contact area 3 is intended to limit movement of the drive unit 6 along the positive x-axis by contacting the inside of bulge 18*a* on its respective side wall.

So damping element 8*a* is able to limit movement of the drive unit 6 in the positive z-, y- and x-direction as well as in negative y-direction.

Referring to FIG. 3 and damping element 8*b*, this damping element 8*b* features two first contact areas 1 on the top, one on each lateral end of damping element 8*b*. Each contact area 1 can feature several bumps, like here two bumps. These first contact areas 1 are intended to limit movement of the drive unit 6 along the positive z-axis by contacting the inside of bulge 18*b* on its top. Damping element 8*b* on its near end in FIG. 3 features one second contact area 2, here in the form of an even surface, facing towards the positive y-axis. This second contact area 2 is intended to limit movement of the drive unit 6 along the positive y-axis by contacting the inside of bulge 18*b* on its respective side wall. Damping element 8*b* on its near end features one third contact area 3, here in the form of an even surface, facing towards the negative x-axis. This third contact area 3 is intended to limit movement of the drive unit 6 along the negative x-axis by contacting the inside of bulge 18*b* on its respective side wall.

Damping element 8*b* on its far end in FIG. 3 features one fourth contact area 4, here in the form of an even surface, facing towards the negative y-axis. This fourth contact area 4 is intended to limit movement of the drive unit 6 along the negative y-axis by contacting the inside of bulge 18*b* on its respective side wall. This fourth contact area 4 is symmetric to the second contact area 2, with relation to a vertical symmetry plane through the axis of the cylinder. Damping element 8*b* on its far end features one third contact area 3, here in the form of an even surface, facing towards the negative x-axis. This third contact area 3 is intended to limit movement of the drive unit 6 along the negative x-axis by contacting the inside of bulge 18*b* on its respective side wall.

So damping element 8*b* is able to limit movement of the drive unit 6 in the positive z- and y-direction as well as in negative x- and y-direction. The third contact areas 3 on the far and near end here form in fact one common plane surface.

Both damping elements 8*a,b* together limit movement of the drive unit 6 in the positive z-direction, in positive and negative y-direction as well as in in positive and negative x-direction. Damping elements 8*a,b* are not able to limit movement of the drive unit 6 in negative z-direction.

The top part 16 of a housing 5 generally has a continuous convex form which means that, in any cross section, the curve of the housing wall is continuously differentiable, there is no step or bend. Now the top part 16 according to the invention has one bulge 18*a* and two bulges 18*b*. Each bulge 18*a,b* has three surfaces which are oriented orthogonally to each other. Bulge 18*a* has two planar surfaces which are orthogonal to the y-axis and one planar surface which is orthogonal to the x-axis. The surface which is orthogonal to the z-axis is slightly curved (smaller than 20°, favourably smaller than 10°) so that in the region where the damping element 8*a* touches the bulge 18*a* the surface is almost plane. First contact area 1 of bulge 18*a* can follow the curved surface form of bulge 18*a*. All bulges 18*b* have one planar surface which is orthogonal to the z-axis, one planar surface which is orthogonal to the y-axis and one planar surface which is orthogonal to the x-axis. So bulge 18*a* covers the whole length of damping element 8*a*. Damping element 8*b* is limited by two bulges 18*b* which are separated from another by another area of top part 16.

A second embodiment of a refrigerant compressor according to the invention is shown in FIG. 5-9. The refrigerant compressor again has a hermetically sealed housing 5, as well as a drive unit 6 disposed in the interior of the housing 5, having a piston/cylinder unit 9 for cyclical compression of a refrigerant, and an electric motor 10 for drive of the piston/cylinder unit 9. From the housing 5 only the top part 16 is shown which faces upward when the compressor is in use. The bottom part 15 which faces downward when the compressor is in use, is not shown. Again, the top part 16 is a cover which is welded to the bottom part 15. The bottom part 15 mainly encloses the electric motor 10, the top part mainly encloses the piston-cylinder unit 9. Again, the drive unit 6 is connected with the bottom part 15 of the housing 5 by means of spring elements, for vibration damping, so that deflections of the drive unit 6 can come about, particularly during start and stop procedures.

Four cap-formed damping elements 7*a,b,c,d* are provided on the drive unit 6, namely on the upper side of block 19 which, beside other functions, acts as the cylinder housing. Damping elements 7*a,b,c,d* prevent the drive unit 6 from making contact with the top part 16 of the housing 5. Every movement or deflection of the drive unit 6 brings about a corresponding deflection of the damping elements 7*a,b,c,d*. The damping element 7*a,b,c,d* can move in a certain extent without touching the top part 16 of housing 5. In normal operation, this makes a certain deflection of the drive unit 6 possible. At very great deflections, such as they occur, in particular, during start and stop procedures or during transport, e.g. the vehicle containing the compressor is moving, climbing or descending a hill, thus causing an inclination of the compressor, the damping element 7*a,b,c,d* touches the top part 16 of the housing 5, thereby causing the damping element 7*a,b,c,d* to be elastically deformed and pressed against the housing 5. This damps and limits the deflection of the drive unit 6, and at the same time does not result in undesirable noise development.

Damping elements 7*a,b,c,d* basically have the same form whereas damping element 7*a* is oriented symmetrical to damping element 7*b* and damping element 7*c* is oriented symmetrical to damping elements 7*d*, always with relation to a vertical symmetry plane through the axis of the cylinder and/or to the crankshaft. In this example the cylinder axis plane is not exactly the same as the crankshaft bearing plane, so damping elements 7*a,b* are symmetric to the cylinder axis plane and damping elements 7*c,d* are symmetric to the crankshaft bearing plane. In other examples the cylinder axis plane may be the same as the crankshaft bearing plane.

For easier reference the same directions and orthogonal axes as in FIG. 1-4 are used.

Damping elements 7*a,b* are mounted surrounding a protruding part 20 of block 19 protruding from the cylinder housing. So damping elements 7*a,b* are situated nearer to the side of the compressor where the cylinder cover 21 and/or the valve plate is situated. Damping elements 7*c,d* are situated nearer to the opposite side of the compressor. All damping elements 7*a,b,c,d* form three contact areas 1-3 which are in use. Each contact area 1-3 contains, here is, an even surface and the three surfaces are oriented orthogonally to each other. In fact every damping element 7*a,b,c,d* forms four contact areas including two third contact areas 3, however, from the two third contact areas acting in direction of the x-axis only one contact area is in use.

Figure 5:
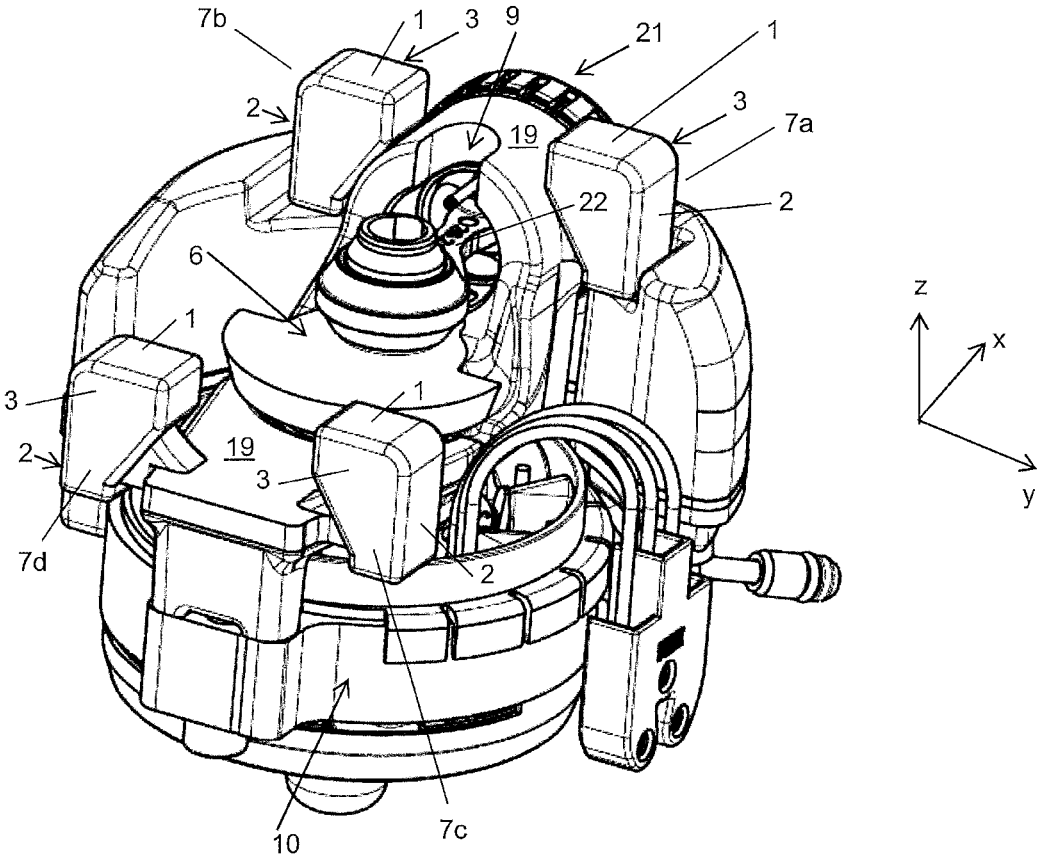

Referring to FIG. 5 and damping element 7*a*, this damping element 8*a* features one first contact area 1 on the top. This first contact area 1 here has the form of an even surface and is intended to limit movement of the drive unit 6 along the positive z-axis by contacting the inside of top part 16 of the housing 5 on its top. The top part 16 of the bulge 17*a* for this reason has been made parallel to the axis of the cylinder. Damping element 7*a* features one second contact area 2, here in the form of an even surface, facing towards the positive y-axis. This second contact area 2 is intended to limit movement of the drive unit 6 along the positive y-axis by contacting the inside of bulge 17*a* on its respective side wall. Damping element 7*a* features one third contact area 3, here in the form of an even surface, facing towards the positive x-axis. This third contact area 3 is intended to limit movement of the drive unit 6 along the positive x-axis by contacting the inside of bulge 17*a* on its respective side wall.

Damping element 7*b* features one first contact area 1 on the top. This first contact area 1, here in the form of an even surface, is intended to limit movement of the drive unit 6 along the positive z-axis by contacting the inside of top part 16 of the housing 5 on its top. The top part 16 adjacent to the corresponding bulge 17*a* for this reason has been made parallel to the axis of the cylinder. Damping element 7*b* features one second contact area 2, here in the form of an even surface, facing towards the negative y-axis. This second contact area 2 is intended to limit movement of the drive unit 6 along the negative y-axis by contacting the inside of corresponding bulge 17*a* on its respective side wall. Damping element 7*b* features one third contact area 3, here in the form of an even surface, facing towards the positive x-axis. This third contact area 3 is intended to limit movement of the drive unit 6 along the positive x-axis by contacting the inside of corresponding bulge 17*a* on its respective side wall.

Damping element 7*c* features one first contact area 1 on the top. This first contact area 1, here in the form of an even surface, is intended to limit movement of the drive unit 6 along the positive z-axis by contacting the inside of bulge 17*b* on its top. Damping element 7*c* features one second contact area 2, here in the form of an even surface, facing towards the positive y-axis. This second contact area 2 is intended to limit movement of the drive unit 6 along the positive y-axis by contacting the inside of corresponding bulge 17*b* on its respective side wall. Damping element 7*c* features one third contact area 3, here in the form of an even surface, facing towards the negative x-axis. This third contact area 3 is intended to limit movement of the drive unit 6 along the negative x-axis by contacting the inside of corresponding bulge 17*b* on its respective side wall.

Damping element 7*d* features one first contact area 1 on the top. This first contact area 1, here in the form of an even surface, is intended to limit movement of the drive unit 6 along the positive z-axis by contacting the inside of bulge 17*b* on its top. Damping element 7*d* features one second contact area 2, here in the form of an even surface, facing towards the negative y-axis. This second contact area 2 is intended to limit movement of the drive unit 6 along the negative y-axis by contacting the inside of corresponding bulge 17*b* on its respective side wall. Damping element 7*d* features one third contact area 3, here in the form of an even surface, facing towards the negative x-axis. This third contact area 3 is intended to limit movement of the drive unit 6 along the negative x-axis by contacting the inside of corresponding bulge 17*b* on its respective side wall.

All four damping elements 7*a,b,c,d* together limit movement of the drive unit 6 in the positive z-direction, in positive and negative y-direction as well as in in positive and negative x-direction. Damping elements 7*a,b,c,d* are not able to limit movement of the drive unit 6 in negative z-direction.

The top part 16 according to this second embodiment of the invention has one bulge 17*a* for damping elements 7*a,b* and two bulges 17*b*, one for damping element 7*c* and one for damping element 7*d*. Each bulge 17*b* has three surfaces which are oriented orthogonally to each other. Bulge 17*a* has two surfaces 12,13 which are oriented orthogonally to each other, the first inner surface area 11 is curved. All bulges 17*b* have one plane surface which is orthogonal to the z-axis, one plane surface which is orthogonal to the y-axis and one plane surface which is orthogonal to the x-axis. Bulge 17*a* has one plane surface which is orthogonal to the y-axis and one plane surface which is orthogonal to the x-axis. The surface which is orthogonal to the z-axis is slightly curved (smaller than 20°, favourably smaller than 10°) so that in the limited region where the damping elements 7*a,b* touch the bulge 17*a* the surface is almost plane. Accordingly, the first inner surface areas 11 still realize a defined stop for the plane first contact areas 1 of damping elements 7*a,b*.

The housing 5 has a wall which wall is deformed so that the wall thickness basically stays the same and the deformed inside and outside surface in this area is still basically parallel to each other. Of course, due to the deformation the thickness, especially in areas with a high curvature, may be reduced, but this is still understood as the wall thickness basically staying the same before and after deformation according to the invention.

Figure 6:
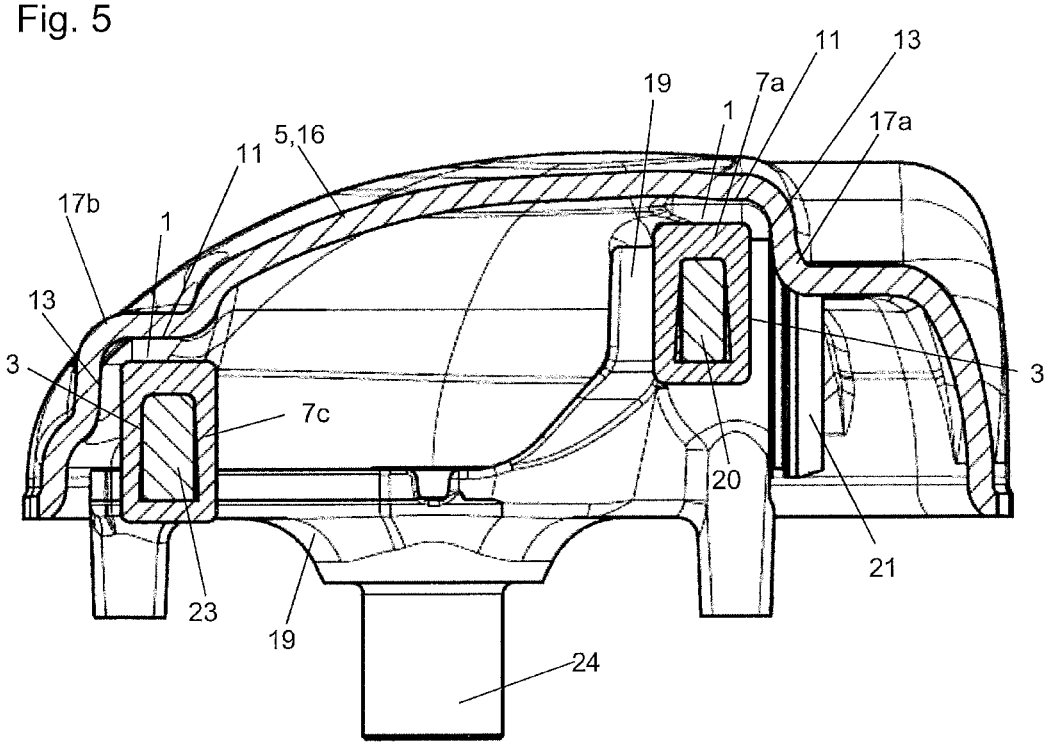

FIG. 6 shows a view of a longitudinal section through the upper portion of the refrigerant compressor of FIG. 5, this time with top part 16 of the housing 5. The drive unit 6 is in the basic position, the damping elements 7*a,c* are not deflected. In this sectional view one can see that damping element 7*a* completely encloses protruding part 20. The same applies for damping element 7*b*. Damping element 7*c* completely encloses second protruding part 23 of the drive unit 6. The same applies for damping element 7*d*. The thickness of the damping element 7*a,c* under first contact area 1 is bigger than the thickness of the damping element under third contact area 3.

When the thickness of the damping elements 7*a-d* under first contact area 1 is bigger than for the other contact areas 2,3 this generally can enhance the stiffness of this central part of the damping element and this can help to avoid an unintended slip-off of the damping element from the protruding part 20,23 if the damping element is snap-fit to the protruding part 20,23. Basically, the thickness of the damping elements 7*a-d*,8*a,b* can be chosen freely, keeping a minimum amount of material that will avoid cracking or failure of the damping elements 7*a-d*,8*a,b* during the life of the compressor.

The surface of the protruding parts 20,23 beneath the first contact area 1 is planar and thus parallel to the first contact area 1. The surface of the protruding parts 20,23 beneath the third contact area 3 is planar and thus parallel to the third contact area 3.

The first inner surface area 11 of the housing 5, which corresponds to the first contact area 1 of the damping element 7*a,c*, is parallel to the first contact area 1. This is at least true for a first inner surface area 11 corresponding to 30-40% of the first contact area 1 on the right of damping element 7*a* in FIG. 6, and for a first inner surface area 11 corresponding to 50-60% on the left of damping element 7*c* in FIG. 6. The third inner surface area 13 of the housing 5, which corresponds to the third contact area 3 of the damping element 7*a,c*, is planar. This is at least true for a third inner surface area 13 corresponding to 20-30% of the third contact area 3 on the top of damping element 7*a* in FIG. 6, and for a third contact area 3 corresponding to 20-30% of the third contact area 3 on the top of damping element 7*c* in FIG. 6.

The block 19 also comprises the crankshaft bearing 24.

Figure 7:
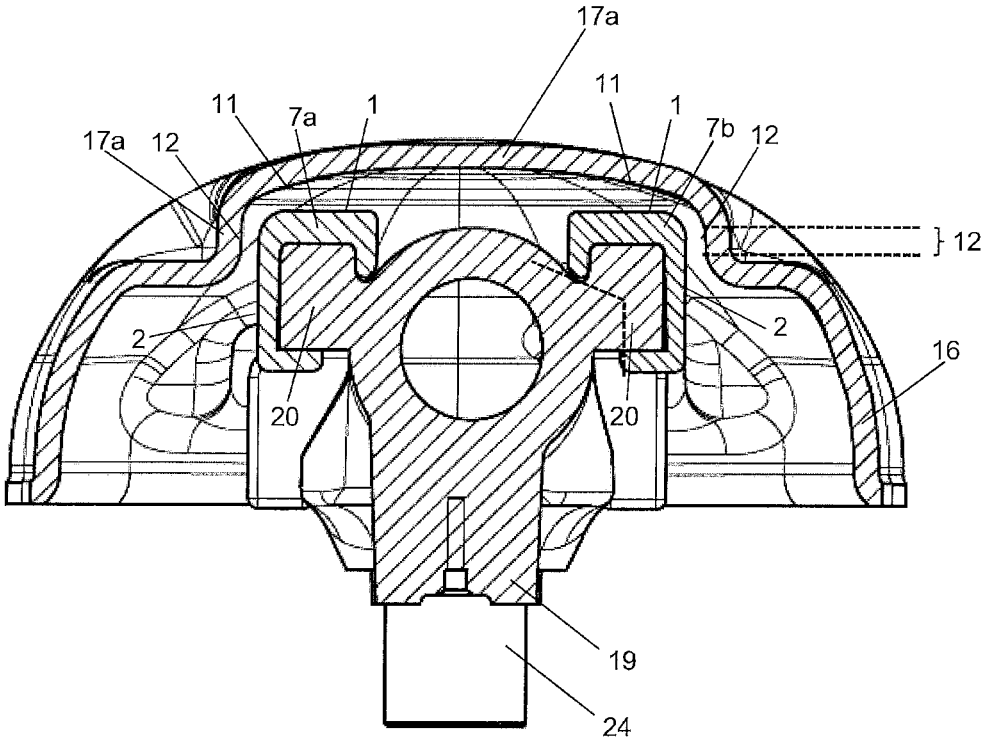

FIG. 7 shows a lateral section through the upper portion of the refrigerant compressor of FIG. 5. The drive unit 6 is in the basic position, the damping elements 7*a,b* are not deflected. In this sectional view one can see that damping element 7*a,b* each encloses protruding part 20 in an amount of approximately 250°, see dotted lines starting from an axis parallel to the x-axis in the middle of protruding part 20. The protruding part 20 here has a rectangular cross section, a major part of its longer side is—in a mathematical sense—fused with the upper part of the cylindrical cylinder housing. The longer side of protruding part 20 here is longer than the piston bore radius but not longer than the piston bore diameter.

Seen in the positive z-direction, the protruding part 20 should preferably not be higher than the upper side of the block 19 at the cylinder housing, thus not increasing the total height of the compressor. It can be allowed to go slightly above this height if the curvature of the housing 5 allows so.

The surface of the protruding parts 20 beneath the first contact area 1 is planar and thus parallel to the first contact area 1. The surface of the protruding parts 20 beneath the second contact area 2 is planar and thus parallel to the second contact area 2.

The first inner surface area 11 of the housing 5, which corresponds to the first contact area 1 of the damping element 7*a,b*, is curved in this section. So the surface form of the of the first inner surface area 11 does not correspond to the form of the first contact area 1 of the damping element 7*a,b*. The second inner surface area 12 of the top part 16 of the housing 5, which corresponds to the second contact area 2 of the damping element 7*a,b*, is planar. This is at least true for a second inner surface area 12 corresponding to 10-20% of the second contact area 2 on the top of damping element 7*a* in FIG. 7.

Figure 8:
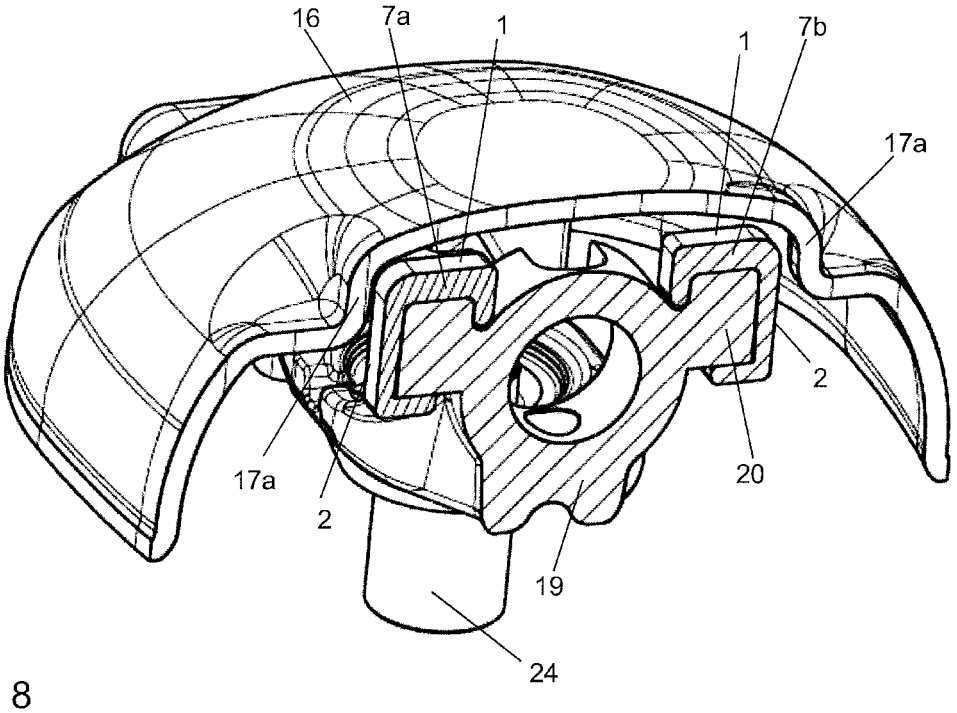

FIG. 8 shows a perspective view of FIG. 7, although the section is in a slightly different place.

Figure 9:
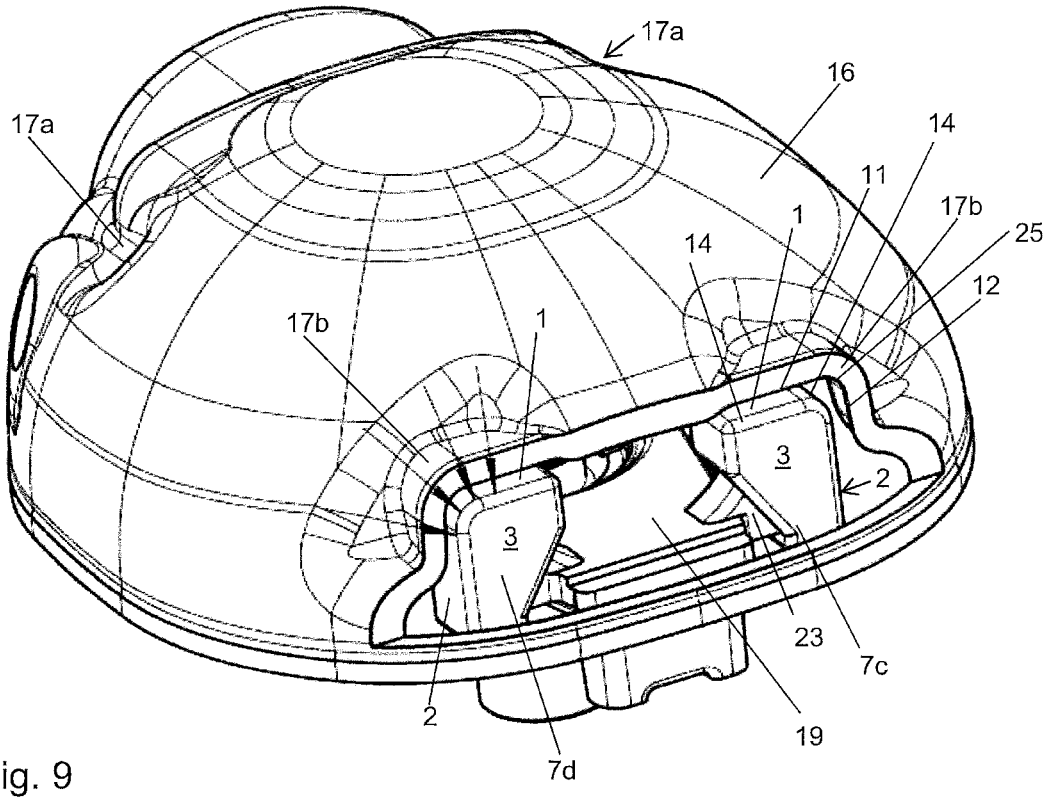

FIG. 9 shows a perspective view of another lateral section through the top part 16 of the housing 5 of the refrigerant compressor of FIG. 5. The section cuts the bulge 17*b* in front of the damping elements 7*c,d* so these are not cut. One can see their third contact areas 3. Arrows here indicate that the damping element 7*c,d* can also damp with the edge 14 between first and second contact area. The corresponding edge 25 between first 11 and second inner surface area 12 of the housing 5 has the same surface form as the edge 14 to bring about a good damping effect for a movement in the direction of the edge 14. This principle of similar edge forms can also be used for edges between first and third contact area 1,3 on the one hand and edges between first 11 and third inner surface area 13 of the housing 5 on the other hand; or for edges between second and third contact area 2,3 on the one hand and edges between second 12 and third inner surface area 13 of the housing 5 on the other hand.

The drive unit 6 and its block 19 is in the basic position, the damping elements 7*c,d* are not deflected. In this view one can see that damping element 7*c,d* each encloses protruding part 23 in an amount of approximately 250°, as in FIG. 7. The protruding part 23 here has also a rectangular cross section, a major part of its longer side is—in a mathematical sense—fused with the upper part of the block 19. The dimensions of protruding part 23 are the same as of protruding part 20.

In FIGS. 5 to 9 with regard to damping element 7*a* the first deflected state of the drive unit is reached (by movement in the positive z-direction) when first contact area 1 is in contact with the corresponding first inner surface 11 area of bulge 17*a*, whereas the second contact area 2 would not be in contact with second inner surface area 12 of bulge 17*a* and whereas the third contact area 3 would not be in contact with third inner surface area 13 of bulge 17*a*. The second deflected state is reached (by movement in the positive y-direction) when the second contact area 2 is in contact with second inner surface area 12 of bulge 17*a*, whereas the first contact area 1 would not be in contact with first inner surface area 11 of bulge 17*a* and whereas the third contact area 3 would not be in contact with third inner surface area 13 of bulge 17*a*. The third deflected state is reached (by movement in the positive x-direction) when the third contact area 3 is in contact with third inner surface area 13 of bulge 17*a*, whereas the first contact area 1 would not be in contact with first inner surface area 11 of bulge 17*a* and whereas the second contact area 2 would not be in contact with second inner surface area 12 of bulge 17*a*. First, second and third deflected state of the drive unit each is an extreme state which describes 100% deflection in x-, y- or z-direction. Such extreme state will hardly be reached during normal operation. During normal operation the drive unit will be in a superposition state of deflection with less than 100% deflection in all three directions.

Figure 10:
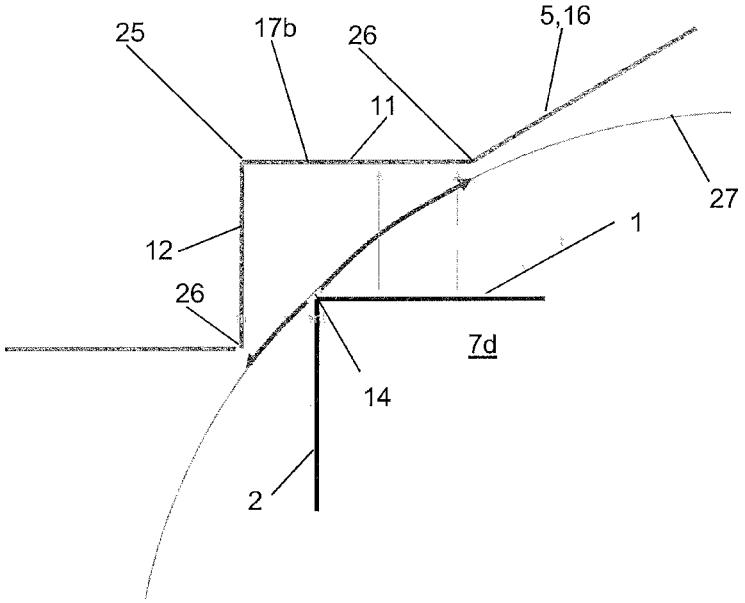

FIG. 10 shows a schematic sectional view of one edge 14 of a damping element 7*a-d*,8*a,b* and the surrounding housing 5. This shall illustrate another principle not shown in FIG. 1-9 in that for a certain damping element the dimensions of first, second and third inner surface area 11,12,13 of the housing 5 can be dimensioned so that until a certain partly deflected state of the drive unit 6 the drive unit can move, e.g. rotate along the curved arrows, without contacting first, second and third inner surface area 11,12,13. The edges 26 of the three inner surface areas 11,12,13 of the housing 5 (which inner surface areas basically can be contacted by the contact areas 1,2,3,4 of the damping element 7*a-d*,8*a,b*) with the adjacent inner surface of the housing are tangents on the surface of a sphere 27 defining the partly deflected state in which the damping element 7*a-d*,8*a,b* does not contact the housing 5. This principle could be applied to compressors with a high amount of displacement during start and stop operation.

The damping elements 7*a-d*,8*a,b* are composed of a polymer material or vulcanized natural rubber, particularly composed of rubber. The damping elements 7*a-d*,8*a,b* can be injection molded or snapped on to the protruding parts 20, 23 of the drive unit 6.

In FIGS. 6 to 9 the minimal distances between contact area 1-3 and corresponding inner surface area 11-13 of the top part 16 of the housing 5 do not show big differences between the different contact areas 1-3. However, one could make the minimal distance between first contact area 1 and first inner surface area 11 bigger than e.g. the minimal distance between second contact area 2 and second inner surface area 12 to allow for a bigger deflection in positive z-direction than in y-direction.

A typical thickness of a metal sheet for forming top part 16 of the housing 5 is 2 to 4 mm. A typical diameter of the housing 5, measured along x- or y-axis, is 100 to 150 mm, or even more for bigger compressors.

Figure 11:
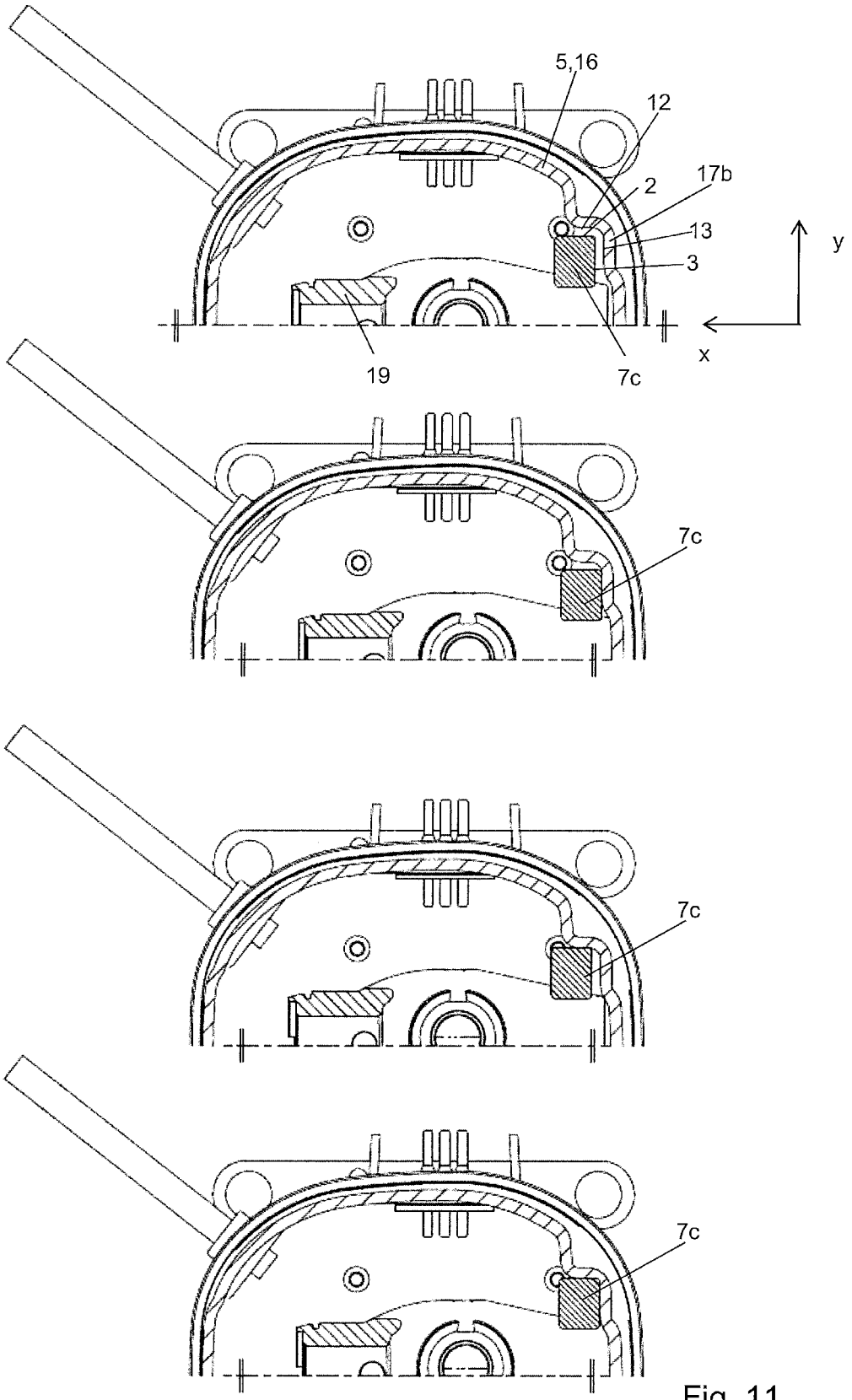

FIG. 11 shows four views of a lateral section through the upper portion of the refrigerant compressor of FIG. 5, for different deflected states. The section is parallel to the xy-plane and cuts the damping element 7*c* near the first contact area 1. The section shows only one half of the compressor, the other half for damping element 7*d* is basically symmetric to the depicted half. The block 19 forming the cylinder housing can be seen as well as the crankshaft. In the first picture the damping element 7*c* is in the basic state, the second and third contact area 2,3 have a defined distance (gap) to the inner surface areas 12,13 of the housing 5. In the second picture the damping element 7*c* has moved along the negative x-axis (along a fifth direction of movement as defined above under FIG. 1-4) to a deflected state where the third contact area 3 is in contact with the third inner surface area 13, whereas the second contact area 2 has not changed its distance to the inner surface area 12. In the third picture the damping element 7*c* has moved along the positive y-axis (along a second direction of movement as defined above under FIG. 1-4) to a deflected state where the second contact area 2 is in contact with the second inner surface area 12, whereas the third contact area 3 has not changed its distance to the inner surface area 13. In the fourth picture the damping element 7*c* has moved in a direction between the positive y-axis and the negative x-axis to a deflected state where the second contact area 2 is in contact with the second inner surface area 12 and the third contact area 3 is in contact with the inner surface area 13. Here the edge between second and third contact area 2,3 is in form-fit contact with the edge between the second and third inner surface area 12,13.

Figure 12:
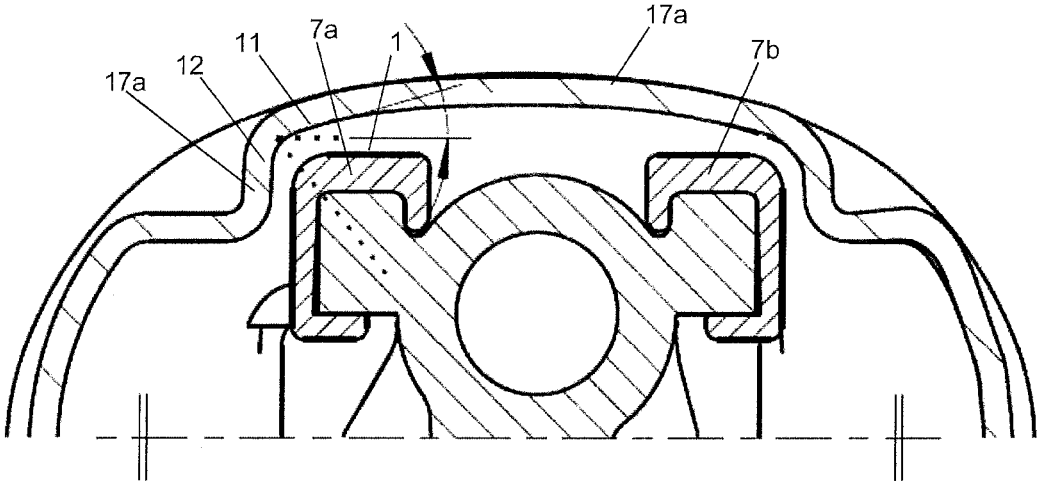

FIG. 12 shows a simplified view of FIG. 7, where the angle between the damping element and the housing has been marked, that is the angle between the first contact area 1 and the first inner surface area 11. Although the first contact area 1 is plane the first inner surface area 11 is curved. The bulge 17*a* accommodating both damping elements 7*a,b* is rather wide in y-direction, so if the bulge would be made plane—in the sense that both first contact areas 1 for damping elements 7*a,b* would be part of one plane area—then the sound emission from this plane portion of metal sheet is higher than for a curved portion of metal sheet and thus could be too high. The angle between the tangent to the first inner surface area 11 and the first contact area 1 can be in the range of 5 to 20°, especially from 10 to 15°. This angle still allows for a determined stop of the damping element 7*a,b* in the positive z-direction.

Figure 13:
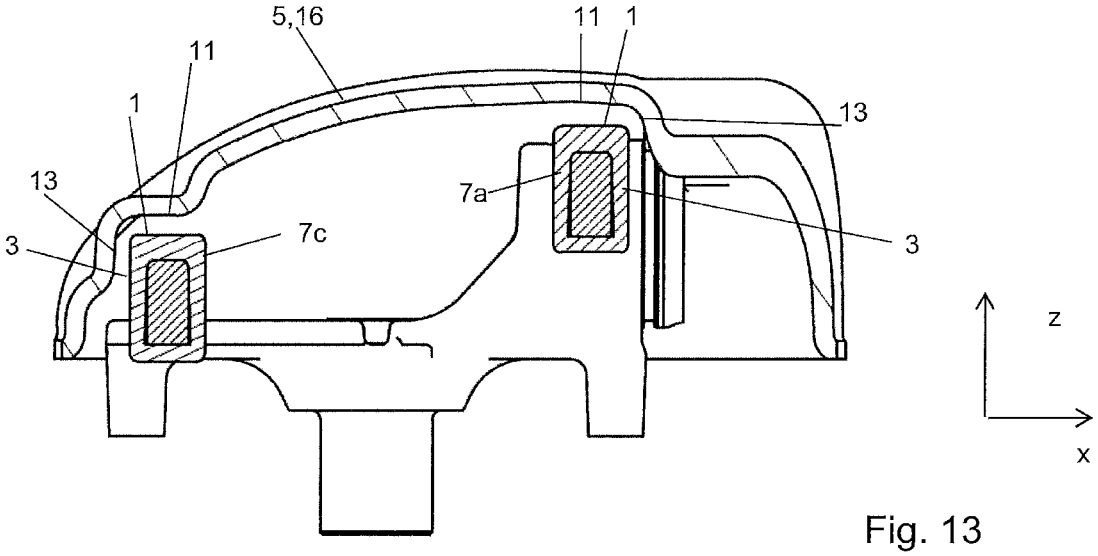

FIG. 13-17 each shows a view of a longitudinal section through the upper portion of the refrigerant compressor of FIG. 5, for different deflected states. FIG. 13-17 each shows a simplified view of FIG. 6. In FIG. 13 the drive unit 6 is in the basic state, the first and third contact area 1,3 of damping elements 7*a,c* have a defined distance (gap) to the inner surface areas 11,13 of the housing 5.

Figure 14:
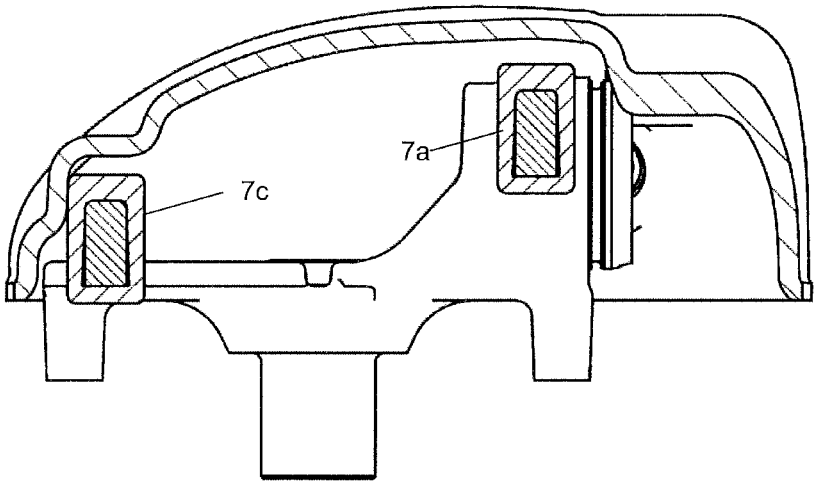

In FIG. 14 the drive unit 6 has moved along the negative x-axis (along a fifth direction of movement as defined above under FIG. 1-4) to a deflected state where the third contact area 3 of damping element 7*c* is in contact with the third inner surface area 13, whereas the first contact area 1 has not changed its distance to the inner surface area 11.

Figure 15:
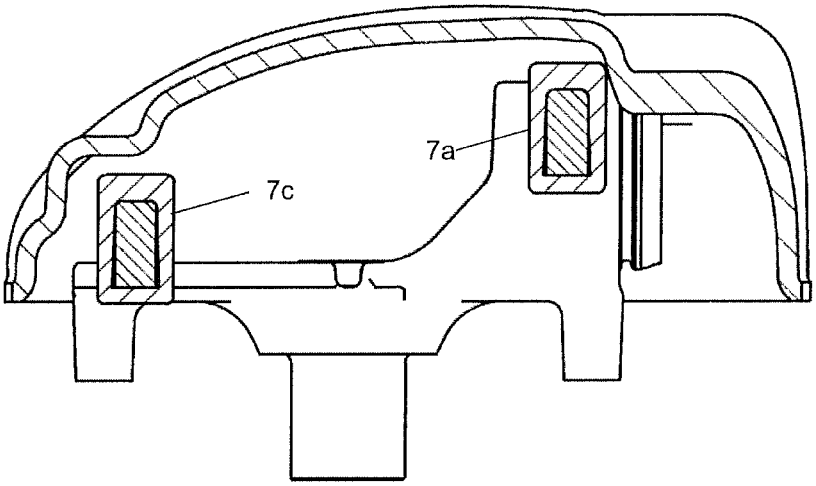

In FIG. 15 the drive unit 6 has moved along the positive x-axis (along a third direction of movement as defined above under FIG. 1-4) to a deflected state where the third contact area 3 of damping element 7*a* is in contact with the third inner surface area 13, whereas the first contact area 1 has not changed its distance to the inner surface area 11.

Figure 16:
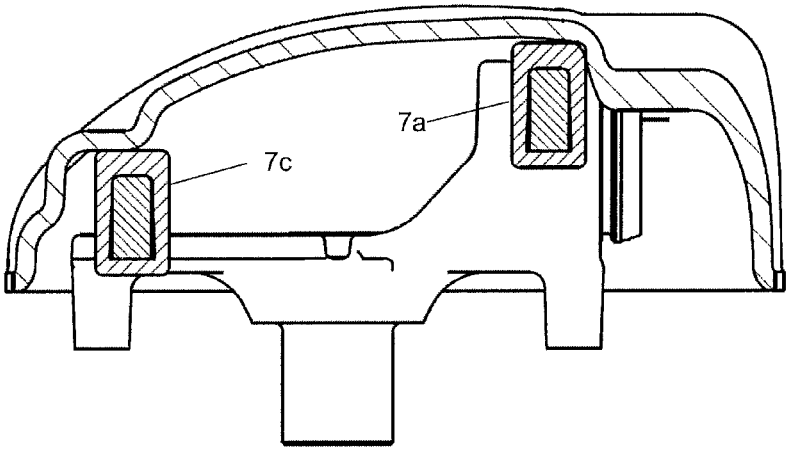

In FIG. 16 the drive unit 6 has moved along the positive z-axis (along a first direction of movement as defined above under FIG. 1-4) to a deflected state where the first contact area 1 of damping element 7*a* and the first contact area 1 of damping element 7*c* is in contact with the first inner surface area 11, whereas the third contact area 3 of each damping element 7*a,c* has not changed its distance to the respective inner surface area 13.

Figure 17:
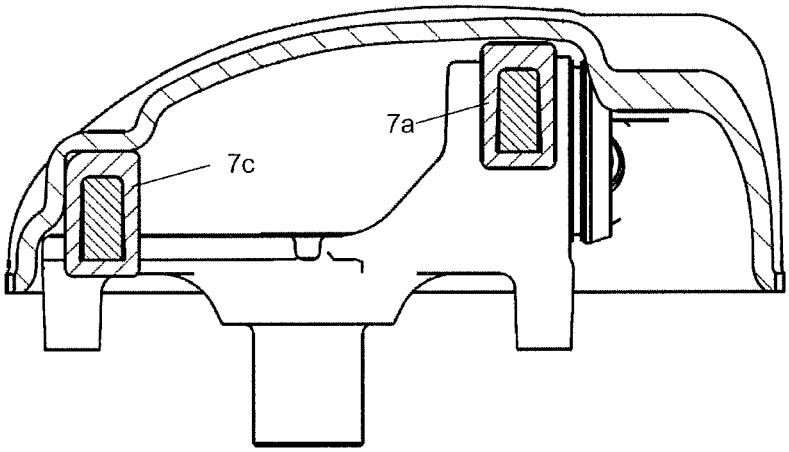

In FIG. 17 the drive unit 6 has moved in a direction between the positive z-axis and the negative x-axis to a deflected state where the first contact area 1 of damping element 7*c* is in contact with its first inner surface area 11, the first contact area 1 of damping element 7*a* is in contact with its first inner surface area 11 and the third contact area 3 of damping element 7*c* is in contact with the inner surface area 13. Here for damping element 7*c* the edge between first and third contact area 1,3 is in form-fit contact with the edge between the first and third inner surface area 11,13.

In a combination of FIG. 11, last picture, and FIG. 17 the drive unit 6 has moved in a direction between the positive z-axis, the negative x-axis and the positive y-axis to a deflected state where the first contact area 1 of damping element 7*c* is in contact with its first inner surface area 11, the second contact area 2 of damping element 7*a* is in contact with its second inner surface area 12 and the third contact area 3 of damping element 7*c* is in contact with its inner surface area 13. Here for damping element 7*c* the corner between first, second and third contact area 1,2,3 is in form-fit contact with the corner between the first, second and third inner surface area 11,12,13.

LIST OF REFERENCE SYMBOLS

1 first contact area
2 second contact area
3 third contact area
4 fourth contact area
5 housing
6 drive unit
7*a,b,c,d* damping element
8*a,b* damping element
9 piston/cylinder unit
10 electric motor
11 first inner surface area of the housing
12 second inner surface area of the housing
13 third inner surface area of the housing
14 edge between first and second contact area
15 bottom part of the housing 5
16 top part of the housing 5
17*a,b* bulge
18*a,b* bulge
19 block
20 protruding part of the drive unit (of the block 19)
21 cylinder cover
22 piston rod
23 second protruding part of the drive unit (of the block 19)
24 crankshaft bearing
25 edge between first and second inner surface area of the housing
26 edge between inner surface areas 11,12,13 and adjacent inner surface of the housing 5
27 sphere

The invention claimed is:

1. A refrigerant compressor comprising a hermetically sealed housing and a drive unit disposed in the interior of the housing, wherein at least one damping element for damping and limiting a deflection of the drive unit is provided in the interior of the housing, wherein the damping element is connected to the drive unit, wherein the damping element has at least one first a first contact area, a second contact area, and a third contact area, wherein in a basic state of the drive unit the at least one first contact area has a distance to a corresponding inner surface area of the housing, wherein in a first deflected state of the drive unit the first contact area is in contact with a corresponding first inner surface area of the housing, wherein the surface of the first inner surface area is parallel to the outer surface of this first area of the housing, wherein in a second deflected state of the drive unit the second contact area is in contact with a corresponding second inner surface area of the housing, but the first contact area is not in contact with the first inner surface area of the housing, whereas the surface of the second inner surface area is parallel to the outer surface of this second area of the housing, whereas the first direction of movement from the basic state to the first deflected state is perpendicular to the second direction of movement from the basic state to the second deflected state, and in that in a third deflected state of the drive unit the third contact area is in contact with a corresponding third inner surface area of the housing, but the first contact area is not in contact with the first inner surface area and the second contact area is not in contact with the second inner surface area, whereas the surface of the third inner surface area is parallel to the outer surface of this third area of the housing, whereas the third direction of movement from the basic state to the third deflected state is perpendicular to the second direction of movement from the basic state to the second deflected state and to the first direction of movement from the basic state to the first deflected state, and in that first contact area, second contact area and third contact area are separated from each other by at least one edge.

2. The refrigerant compressor according to claim 1, wherein the surface form of the first contact area of the damping element corresponds to the surface form of the first inner surface area of the housing, and/or the surface form of the second contact area of the damping element corresponds to the surface form of the second inner surface area of the housing, and/or the surface form of the third contact area of the damping element corresponds to the surface form of the third inner surface area of the housing.

3. The refrigerant compressor according to claim 1, wherein at least two contact areas of the damping element are planar and oriented perpendicular to each other.

4. The refrigerant compressor according to claim 3, wherein the third contact area of the damping element is planar and oriented perpendicular to the other two contact areas.

5. The refrigerant compressor according to claim 4, wherein the first, second, and third inner surface areas of the housing are planar and oriented perpendicular to each other.

6. The refrigerant compressor according to claim 3, wherein the protruding part of the drive unit has at least two planar surface areas which are covered by the damping element, which are oriented perpendicular to each other and which are oriented parallel to at least two planar contact areas of the damping element.

7. The refrigerant compressor according to claim 1, wherein the damping element is injection molded to a part of the drive unit.

8. The refrigerant compressor according to claim 1, wherein in a fourth deflected state of the drive unit a fourth contact area is in contact with a corresponding fourth inner surface area of the housing, whereas the surface of the fourth inner surface area is parallel to the outer surface of this fourth area of the housing, whereas the fourth direction of movement from the basic state to the fourth deflected state is antiparallel to the direction of movement from the basic state to the second deflected state.

9. The refrigerant compressor according to claim 8, wherein there are two damping elements, and whereas the directions of movement from the basic state to the third deflected state are antiparallel.

10. The refrigerant compressor according to claim 1, wherein there is a first and a second damping element, whereas the first direction of movement from the basic state to the first deflected state and the third direction of movement from the basic state to the third deflected state is the same for both damping elements, and the directions of movement from the basic state to the second deflected state are antiparallel.

11. The refrigerant compressor according to claim 10, wherein there are a third and a fourth damping element, whereas the first direction of movement from the basic state to the first deflected state is the same for all four damping elements, whereas the direction of movement from the basic state to the second deflected state is antiparallel to each other and whereas the direction of movement from the basic state to the third deflected state is antiparallel to the first and second damping element.

12. The refrigerant compressor according to claim 1, wherein in the basic state of the drive unit the first contact area has the first distance to the corresponding first inner surface area of the housing, the second contact area has a second distance to the corresponding second inner surface area of the housing and the third contact area has a third distance to the corresponding third inner surface area of the housing, and in that one of these distances is different from another of these distances.

13. The refrigerant compressor according to claim 1, wherein there is a first thickness of the damping element measured at the first contact area, a second thickness of the damping element measured at the second contact area and a third thickness of the damping element measured at the third contact area, and in that one of these thicknesses is different from another of these thicknesses.

14. The refrigerant compressor according to claim 1, wherein for the at least one damping element the dimensions of the first, second, and third inner surface areas of the housing are dimensioned so that until a certain partly deflected state of the drive unit the drive unit can move without contacting the first, second, and third inner surface areas.

15. The refrigerant compressor according to claim 3, wherein the protruding part of the drive unit has three planar surface areas which are covered by the damping element, which are oriented perpendicular to each other and which are oriented parallel to three planar contact areas of the damping element.

* * * * *